United States Patent [19]

Deike

[11] 4,096,673

[45] Jun. 27, 1978

[54] METHOD OF ANCHORING

[75] Inventor: Robert F. Deike, Cheyenne, Wyo.

[73] Assignee: Foresight Industries, Cheyenne, Wyo.

[21] Appl. No.: 740,946

[22] Filed: Nov. 11, 1976

Related U.S. Application Data

[60] Division of Ser. No. 668,695, Mar. 19, 1976, Pat. No. 4,044,513, which is a continuation-in-part of Ser. No. 535,428, Dec. 23, 1974, Pat. No. 3,969,854.

[51] Int. Cl.[2] ..... E02D 5/80

[52] U.S. Cl. ..... 52/156; 52/163; 61/39

[58] Field of Search ..... 61/53.64, 53.6, 53.54, 61/53.52, 53.56, 53.58, 39, 35; 52/162, 163, 164, 165

[56] References Cited

U.S. PATENT DOCUMENTS

| | | | |
|---|---|---|---|
| 936,824 | 10/1909 | Simpson et al. | 52/163 |
| 972,306 | 10/1910 | Wilcox | 52/163 |
| 1,052,700 | 2/1913 | Warrick | 52/163 |
| 3,375,884 | 4/1968 | Bodine | 61/53.64 X |
| 3,665,717 | 5/1972 | Sweeney et al. | 61/53.68 X |
| 3,742,717 | 7/1973 | Wey | 61/53.6 X |
| 3,888,057 | 6/1975 | Zubke | 52/163 |
| 3,935,912 | 2/1976 | Shibata | 61/53.68 |
| 3,969,853 | 7/1976 | Deike | 52/156 |

FOREIGN PATENT DOCUMENTS

| | | | |
|---|---|---|---|
| 623,854 | 7/1961 | Canada | 61/53.52 |

*Primary Examiner*—Dennis L. Taylor

*Attorney, Agent, or Firm*—Hill, Gross, Simpson, Van Santen, Steadman, Chiara & Simpson

[57] ABSTRACT

Cables are anchored in the ground by attaching one end of the cable to an intermediate portion of an elongated tubular member having a leading driving end with an internal abutment and a trailing end with an out turned lip on the side of the tubular member opposite the side on which the cable is attached. A driving tool inserted into the member drives into the earth in an upright position to a desired depth. The driving tool is removed from the member, the cable is tensioned to rotate the member in the earth about the lip into a position transversely of its driving position thereby forming a nonretractable anchor or support for the cable. Concrete slurry can fill the hole in the earth formed by driving the anchor into the ground with the cable surrounded by the slurry. A plug pressed into the hole compresses the slurry causing it to flow into crevices and pores in the earth surrounding the hole. The concrete may then be poured into the hold above the plug while the cable is held under tension and, after the concrete sets, a tensioned cable reinforced column of concrete cooperates with the anchor to provide a firmly secured cable. An entrance hole of larger diameter than the hole formed by driving the anchor into the earth but only extending to a depth less than the depth to which the anchor is driven can be swaged into the earth and will thus be surrounded by compacted earth. This entrance hole can be lined with a tube to keep the hole in an open condition during the driving of the anchor, the liner can then be withdrawn and the entrance hole filled with concrete which is pressed by a plug forming a concrete column interlocked with the earth and embedding the anchor and cable.

4 Claims, 12 Drawing Figures

G
A
E.H.
T
N
A'
XII
41
42
D
M
11
33a
33
32
K
B
10
42a
44
43
43a
39
37
40
35
34
38
36
31
H
20
13
C
16
29
30
22
28
IX
24

METHOD OF ANCHORING

RELATED APPLICATIONS

This application is a division of my U.S. patent application Ser. No. 668,695 entitled "Earth Anchor" now U.S. Pat. No. 4,044,513, issued Aug. 30, 1977 which in turn is a continuation-in-part of my patent application Ser. No. 535,428, filed Dec. 23, 1974, entitled "Planing Fin Anchor" now U.S. Pat. No. 3,969,854 issued July 20, 1976.

FIELD OF THE INVENTION

This invention relates to the art of anchoring cables in the ground with tubular anchors that are driven lengthwise into the ground to a desired depth, pulling the cable therewith, and then tilted transversly of the hole by tensioning the cable. The cable is further anchored in the ground by concrete poured therearound filling the hole and preferably pressed into the hole to flow into voids and pores in the ground surrounding the hole.

BRIEF SUMMARY OF THE INVENTION

In my aforesaid U.S. Pat. No. 3,969,854 issued July 20, 1976, I have disclosed and claimed a ground anchor for cables which is generally T-shaped having outturned flanges and a central longitudinal web to which the cable is attached. This T-shaped anchor is either dropped into a pre-formed hole in the ground or is driven into the ground by impacting its trailing end. I have now improved this type of ground anchor by providing a hollow tubular anchor which is driven into the ground from its leading end and is held in the desired upright position by a driving ram which receives the anchor therearound thus insuring the formation of a straight hole and preventing the anchor from tilting prior to reaching its desired depth. An important feature of the invention is the filling of the hole above the anchor with concrete, the pressing of the concrete in the hole to spread out laterally filling voids and pores in the ground and forming tentacles and fins increasing the anchor grip. Another important feature is the tensioning of the cable during the setting of the concrete so that the concrete column filling the hole is compressively stressed increasing its column strength.

It is an object of this invention to provide a method of anchoring cables and the like by inserting a driving rod into a tubular anchor carrying a cable, impacting the rod to drive the anchor upright into the ground pulling the cable therewith, withdrawing the rod and tensioning the cable to rotate the anchor about an outturned lip on one end thereof.

Another object of the invention is to provide a method of anchoring cables in the ground including the step of inserting a ground anchor lengthwise into the ground to a desired depth pulling the cable therewith, then tensioning the cable to tilt the anchor into transverse locking position in the ground, next filling the hole with concrete and compressing the concrete to force it laterally of the hole into voids and pores of the ground forming a concrete column with laterally extending fins and tentacles interlocked in the ground.

A further object of the invention is to improve the art of anchoring cables in the ground by swaging an entrance hole in the ground compacting the ground surrounding the hole, to then drive a cable carrying anchor into the ground below the hole followed by a tilting of the anchor transversely of the hole, filling the hole with concrete, and pressing a plug into the swaged hole to force the concrete laterally of the driven hole forming a concrete column with laterally extending tentacles and fins firmly interlocked in the ground and surrounding the cable attached to the anchor.

A specific object of the invention is to increase the anchoring capacity of ground anchors for cables by filling the hole above the anchor around the cable with concrete and compressing the concrete to force it into the ground surrounding the hole thereby forming tentacles and fins locked in the ground.

Other and further objects of this invention will become apparent to those skilled in this art from the following detailed description of the annexed sheets of drawings which, by way of a preferred example only, illustrate one embodiment of the invention.

ON THE DRAWINGS

AS SHOWN ON THE DRAWINGS

Figure 1:
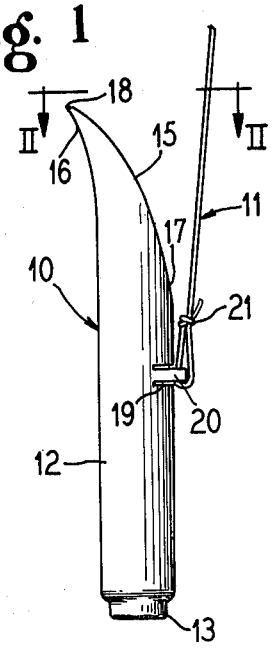
FIG. 1 is a side elevational view of the tubular ground anchor showing a cable attached thereto as used in the method of this invention.
Figure 3:
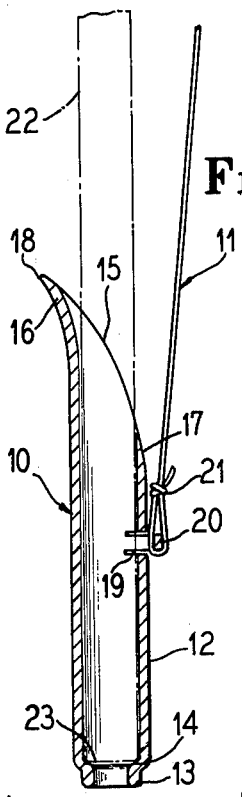
FIG. 3 is a longitudinal cross-sectional view of the ground anchor of FIG. 1 showing a driving ram inserted therein for guiding the anchor and impacting against the leading end thereof.
Figure 2:
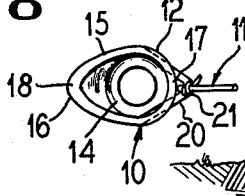
FIG. 2 is a top plan view of the anchor and cable of FIG. 1 taken along the lines II—II of FIG. 1.

The ground anchor 10 used in the method of this invention is attached to an external cable 11 about midway between its ends as shown in FIGS. 1 to 3. The anchor 10 is composed of a metal tube 12 with a reduced diameter leading driving end 13 providing an interal abutment shoulder 14, and with a tapered trailing end 15 having an out-turned lip 16. The tube 12 is cut or ground off from a level 17 along an arcuate path to the rounded tip end 18 of the lip 16. The tube is lanced transversely at 19 below the bottom end 17 of the tapered trailing end 15 and a kerf is pressed outwardly from the lanced section 19 to provide a rigid bail-like strap 20 around which cable 11 is tied as shown at 21. The anchoring strap 20 for cable 11 is positioned on the opposite side of the tube body 12 from the lip 16 and rearwardly of the transverse center of mass of the tube 12 so that when the anchor is freely suspended from the cable, its leading end 12 will tilt downwardly at an angle of about 15° degrees from the horizontal. Since the tapered trailing end 15 has less metal along its length than the leading end 13, the strap 20 may be positioned about midway between the leading end 13 and the tip 18 and still leave most of the mass forwardly of the strap so that the freely suspended anchor will tilt with its leading end downwardly.

The anchor 10 may vary greatly in diameter, length and thickness depending upon the load it is to carry and the soil conditions of the ground in which it is to be driven. Typical anchor lengths will vary from two inches to about twenty-inches and typical anchor diameters will vary from about one-quarter inche to three inches. The wall thickness may vary from one-sixteenth to one-quarter of an inch. The angle of the tapered end 15 is less than 45° to provide an elongated contour. Angles of about 15° to 30° are preferred.

The leading end 13 of the anchor 10 may be an integral contracted end of the metal tube 12 or may be a welded-on head of hardened steel contrasted with the tubular steel body 12. If desired, the leading end may be closed and provided with a driving point.

Figure 4:
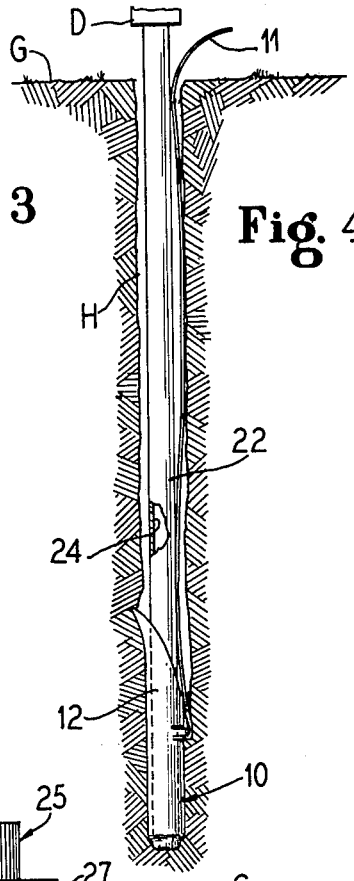
FIG. 4 is a side elevational view showing the manner in which the ground anchor of FIGS. 1 to 3 is driven into the ground and showing the ground surrounding the driven hole in longitudinal section.

As shown in FIGS. 3 and 4, the tube 12 slidably receives a driving and guide rod 22 with a leading end 23 adapted to impact against the internal abutment shoulder 14 of the tube. This driving and guide rod 22 may be hollow and have a central bore 24 therethrough as shown in FIG. 4.

As also shown in FIG. 4, the anchor 10 is driven into the ground G by a driver D acting on the top end of the hollow rod 22 and forming a hole H in the ground with the cable 11 extending from the anchor 10 through the hole to a level above the ground.

The rod 22 holds the anchor 10 in upright position parallel with the hole H and prevents the anchor from tilting or wandering out of parallel alignment with the hole that is being formed. The rod 22 may be pressed or repeatedly impacted against the shoulder 14 without being withdrawn from the tubular body 12 to insure maintenance of the anchor in its desired upright position until it has reached a desired depth.

Figure 5:
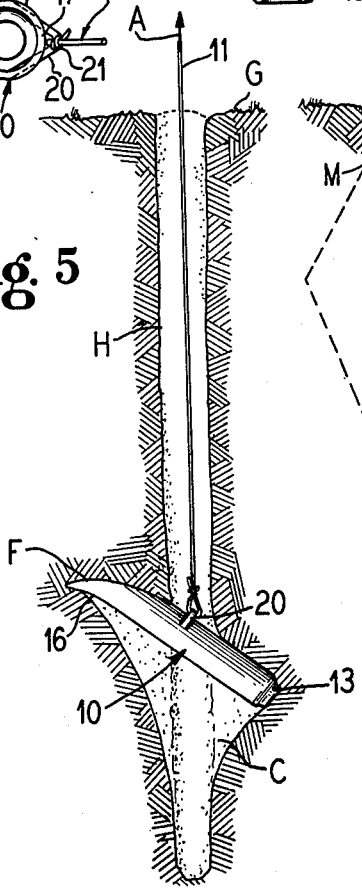
FIG. 5 is a view similar to FIG. 4 but illustrating the tilted position assumed by the ground anchor transversely of the hole when the cable is tensioned.

As shown in FIG. 5, after the anchor 10 has reached a desired depth in the ground G, the driving rod 22 is retracted from the hole H and the cable 11 is pulled in the direction of the arrow A. This tension pull on the cable causes the lip 16 to plough into the ground alongside the hole H forming a fulcrum F for the anchor which will cause the leading end 12 to be pulled upwardly into the ground on the opposite side of the hole whereupon the anchor 10 assumes an inclined position transversely of the hole. This tilting or rotation of the anchor 10 leaves a somewhat enlarged cavity C in the hole H below the anchor, but the leading end 13 of the trailing end 16 of the anchor are firmly embedded in the ground G laterally of the hole H and the cavity C.

Figure 6:
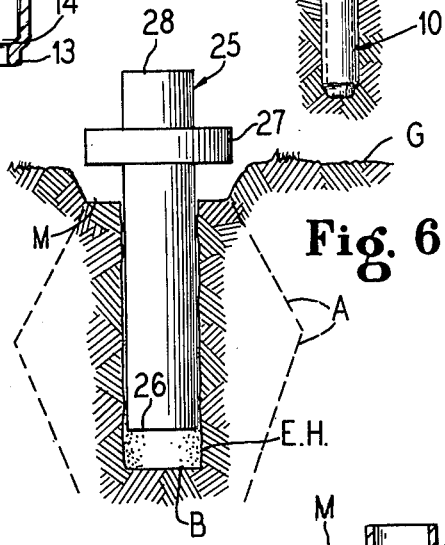
FIG. 6 is a view illustrating the formation of a shallow entrance hole in the ground for the ground anchor by means of an impact swaging tool which compacts the ground surrounding the shallow hole.
Figure 7:
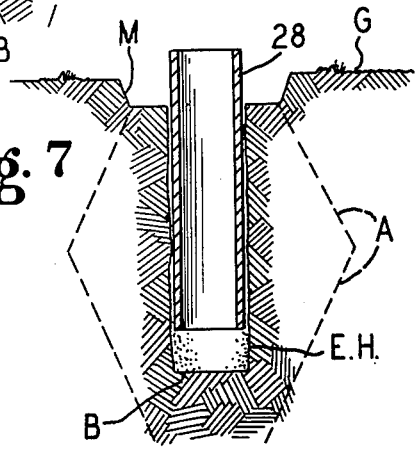
FIG. 7 is a view similar to FIG. 6 but showing the insertion of a tubular liner in the swaged hole to prevent collapsing of the hole during subsequent operations.

FIGS. 6 and 7 show an initial formation of a compacted entrance hole E.H. of larger diameter than the hole H providing a tightly packed area A surrounding the hole. This entrance hole E.H. is conveniently formed by a swage tool 25 with a flat leading end 26 and a surrounding collar 27 adjacent the trailing end 28. The trailing end is adapted to be struck by a hammer type driving machine forcing the leading end 26 into the ground G and spreading the ground to accept the tool thereby compacting the ground around the hole that is formed by the tool. The compacted area diverges from the ground level to a depth above the bottom of the hole E.H. and then converges toward the bottom of the hole. The collar 27 is impacted against the top of the ground and forms a larger diameter mouth M at the top of the hole E.H.

The tool 25 is of larger diameter than the major transverse diameter of the ground anchor 10 in its upright driving position so that the hole E.H. will be of larger diameter than the hole H. The depth of the hole E.H. will vary with the type of surrounding soil with a lesser depth being sufficient for dense heavy soil. The depth of the hole E.H. is substantially less than the depth of the hole H. The hole E.H. will have a flat bottom B.

As shown in FIG. 7, a metal or plastic tube 28 is dropped into the hole E.H. to form a liner preventing collapse of the hole especially in sand or gravel soil conditions. The tube 28 provides a liner which holds the area A of compacted soil.

Figures 8, 9, 10, 11, 12:
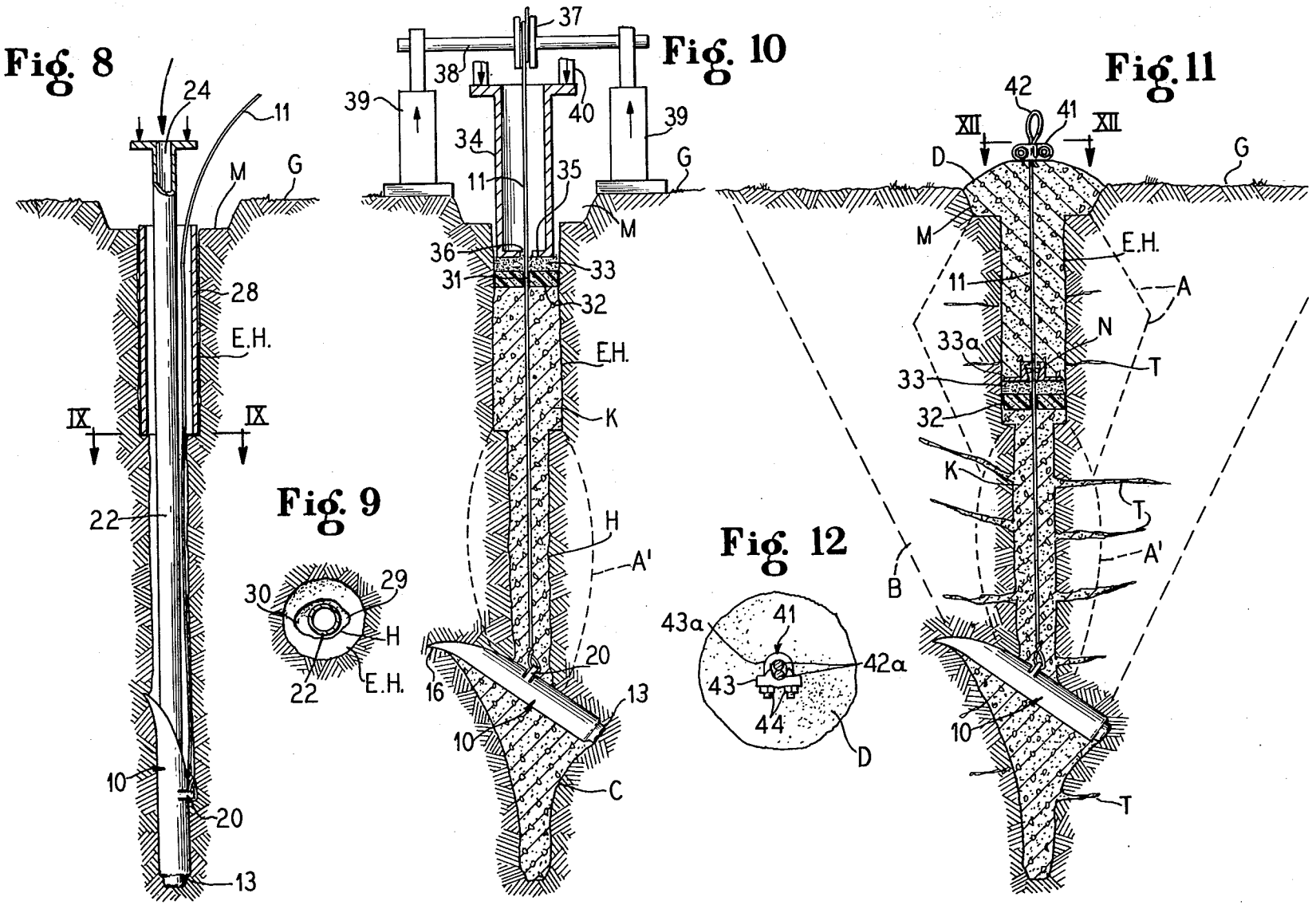
FIG. 8 is a view similar to FIG. 4 but also showing a swaged entrance hole lined with the tube of FIG. 7.
FIG. 9 is a transverse sectional view along the lines IX—IX of FIG. 8.
FIG. 10 is a view similar to FIG. 8 but showing the filling of the swaged and driven holes with concrete and the compressing of the concrete around the cable.
FIG. 11 is a view similar to FIG. 10 but illustrating the concrete filled hole in finished condition.
FIG. 12 is a transverse sectional view along the lines XII—XII of FIG. 11.

As shown in FIG. 8, the hollow driving ram 22 extends freely through the liner tube 28 and into the anchor 10. As illustrated in FIG. 8, the anchor 10 has been driven to its desired depth below the entrance hole E.H. and remains in its upright driving position on the end of the ram 22.

As shown in FIG. 9, the entrance hole E.H. is circular in cross-section while the hole H has a small circular cross-section with diametrically opposed grooves 29 and 30 formed respectively by the strap 20 and cable 11 on one side of the anchor 10 and the out-turned lip 16 on the opposite side of the anchor. The groove 29 is somewhat smaller than the groove 30.

After the ram 22 has driven the anchor 10 to its desired depth it is retracted from the anchor and the cable 11 is pulled to rotate the anchor transversely of the hole H to the inclined position of FIG. 10. A fluid concrete slurry is then poured or pumped through the hollow interior 24 of the ram 22 to be forced into the bottom of the hole H and fill the cavity C below the tilted anchor 10. The ram 22 is gradually retracted from the hole H as concrete fills the hole H. The plastic or metal line tube 28 is withdrawn from the entrance hole E.H. and this hole is also filled with concrete. The ram 22 may be withdrawn from the hole E.H. as the tube 28 is withdrawn so that concrete fills the enlarged hole without permitting any of the surrounding soil to drop into the hole.

The cable 11 is threaded through the central aperture 31 of a circular plug 32 tightly fitting the hole E.H., the plug is pushed into the hole E.H. thereby centering the cable in the column of concrete below the plug. The plug 32 is preferably composed of material which expands under compression, such as styrofoam, so that the plug will fit rightly in the hole E.H. A layer of sand 33 is next deposited in the hole E.H. above the plug 32 to form a seal and a pressing tool 34 of smaller diameter than the hole E.H. has a flat bottom face 35 resting on the sand 33 with a central aperture 36 freely receiving the cable 11 therethrough. The cable 11 passes through the tool 34 and is anchored around a pulley 37 carried by a cross member 38 supported by jacks 39 resting on the ground G. These jacks 39 raise the pulley 37 to tension the cable 11. A downward load 40 is then placed on the tool 34 to force it into the hole E.H. hereby compressing the column K of concrete beneath the plug and forming a second compacted ground area A' around the hole H. As the plug 32 is forced toward the bottom of the hole E.H., concrete from the column K is forced laterally of the aligned holes E.H. and H to form laterally extending fins or tentacles T as shown in FIG. 11. These lateral tentacles interlock with the soil surrounding the holes to prevent the column of conrete K from shifting in the ground.

The concrete below the depressed plug 32 is held under compression by placing a plate or cover 33*a* on the sand seal 33, threading the cable 11 through the plate and through a lock nut N, pressing the nut against the plate and tensioning the cable in the nut. The nut N will grip the cable to keep it under tension and to press the plug 32 against the underlying concrete column K. The tensioned cable between the anchor 10 and plug 32 will compressibly load the concrete as it sets to form a compression loaded concrete column K. Maintenance of the compression load on the concrete is especially useful in expansion soil conditions such as wet clay to anchor the concrete in the hole H.

As also shown in FIG. 11, the concrete tentacles T fill all of the voids in the ground and a diverging cone B of soil extends from the anchor 10 around the compacted areas A and A' to the ground level. This cone B shows the large plug or mass of soil that would have to be displaced before the concrete column K and the ground anchor 10 could be lifted. As also illustrated in FIG. 11, the hole E.H. above the depressed plug 32 and sand seal 33 is also filled with concrete as is the mouth M. The concrete in the mouth M can be built up above ground level to form a dome D.

The length of the cable 11 above the nut N is preferably also maintained under tension as the concrete sets and a clamp 41 is secured around a looped end 42 of the cable 11 resting on the dome D of the concrete column in the entrance hole E.H. As shown in FIG. 12, this clamp 41 is composed of a bracket and U-bolt 43 receiving therebetween the legs 42*a* of the looped end 42 of the cable 11 and drawn together by draw bolts 44 to hold the loop closed. When tension on the cable 11 is released, the clamp 41 will seat firmly on the dome D of the column of concrete and the concrete column in the entrance hole E.H. will be held under compression between the anchor 10 and the plate 33*a*.

The looped end 42 of the cable can be attached to guy wires, ground plates or the like to firmly anchor above ground structures to the ground.

The ground anchor 10, the ground compacting and concrete pressurizing together with the tensioned cable locked in a column of concrete provides a superior anchor assembly which will not heave or shift during freezing or under load and which forms large shear planes in the ground above the anchor resisting retraction of the anchor.

The anchors used in the method of this invention are relatively light in weight, inexpensive and easy to install.

It should be understood that the term "cable" as used herein and in the claims includes chains, wires, rods, ropes and the like as well as conventional cables.

I claim as my invention:

1. The method of forming a ground anchor which comprises inserting a driving tool into the trailing end of a hollow tubular member having a driving end with an internal abutment adapted to be impacted by the driving tool for forcing the member lengthwise into the ground, providing an out-turned lip on the open trailing end of the member as a continuation of one side of the member to form a fulcrum for tilting the member, attaching a cable to the side of the member opposite the out-turned lip side, impacting the tool against said internal abutment for driving the tubular member with the cable attached to a desired depth in the ground, pulling the cable to rotate the tubular member transversely of the hole formed by the driving operation, filling the hole with concrete, tensioning the cable to center it in the column of concrete above the tubular member, compressing the concrete column to compact the ground surrounding the hole and to fill voids in the ground with concrete, and setting the concrete around the tensioned cable to form a compression loaded concrete column.

2. The method of claim 1 including the step of swaging the ground to form a compacted entrance hole receiving the tube.

3. The method of claim 2 including the added step of forcing a plug into the entrance hole to compress the concrete.

4. The method of claim 2 including the steps of inserting a hollow driving rod in the tube, impacting the rod against the leading end of the tube to driving the tube into the ground, retracting the rod from the tube and pumping concrete through the rod to fill the hole.

* * * * *